United States Patent [19]

Cartner

[11] Patent Number: 4,459,767

[45] Date of Patent: Jul. 17, 1984

[54] DITCHER HEAD ASSEMBLY FOR CLEANING DITCHES

[76] Inventor: Jack O. Cartner, 1005 N. 8th St., Cambridge, Ohio 43725

[21] Appl. No.: 416,579

[22] Filed: Sep. 10, 1982

[51] Int. Cl.[3] ..... E02F 5/04

[52] U.S. Cl. ..... 37/81; 15/93 B; 37/DIG. 17

[58] Field of Search ..... 37/80 R, 80 A, 81, 82, 37/89, 91, 94, 256, 259, 232, 116, 189, DIG. 17, 261, 234; 15/93 B

[56] References Cited

U.S. PATENT DOCUMENTS

| | | | |
|---|---|---|---|
| 1,911,516 | 5/1933 | Landing . | |
| 2,457,693 | 12/1948 | Leicy | 56/25 |
| 2,588,004 | 3/1952 | Holmes | 56/25 |
| 2,685,751 | 8/1954 | Bain | 37/189 X |
| 2,770,893 | 11/1956 | Jacobs | 37/256 |
| 2,791,081 | 5/1957 | Allen et al. | 56/25.4 |
| 2,832,183 | 4/1958 | Pittman | 56/25 |
| 2,997,835 | 8/1961 | Stewart | 56/25 |
| 3,045,413 | 7/1962 | Sheffer | 56/25.4 |
| 3,087,296 | 4/1963 | Cowles | 56/17.1 |
| 3,308,611 | 3/1967 | Barber | 56/25 |
| 3,353,286 | 11/1967 | Marks | 37/261 |
| 3,423,857 | 1/1969 | Ibisch | 37/259 |
| 3,683,522 | 8/1972 | Rousseau et al. | 37/189 X |
| 3,949,539 | 4/1976 | Cartner | 56/10.4 |
| 4,048,789 | 9/1977 | Cartner | 56/11.9 |
| 4,109,336 | 8/1978 | Ford | 37/82 |
| 4,193,217 | 3/1980 | Poche | 37/189 |
| 4,206,580 | 6/1980 | Truax et al. | 56/10.4 |
| 4,320,589 | 3/1982 | Pezazza | 37/232 |

FOREIGN PATENT DOCUMENTS

| | | | |
|---|---|---|---|
| 434158 | 10/1974 | U.S.S.R. | 37/189 |
| 611967 | 6/1978 | U.S.S.R. | 37/80 R |
| 699119 | 11/1979 | U.S.S.R. | 37/81 |

*Primary Examiner*—E. H. Eickholt

*Attorney, Agent, or Firm*—Fay & Sharpe

[57] ABSTRACT

A ditcher head assembly adapted for mounting on a tractor which moves with the tractor along the berm of a highway so that the ditcher head assembly clears earth and debris in a propellor-like action from the side of a ditch and throws it laterally either off the highway or onto the berm. With the ditcher head assembly of this invention it is possible to control the placement of earth and debris. The ditcher head is rotated axially of the ditch so that each incremental portion of earth in a ditch is engaged by a cutting blade. The ditcher head assembly is mounted on a tractor by means of a stand and outrigger members and extends over the berm of a highway, having the capacity to elevate and depress. The tractor is of regulation road width when in traveling position.

The ditch head assembly is hydraulically controlled for positioning off the highway to a reasonable ditch depth. Hydraulic protection is also provided the ditcher head should it meet with an obstruction in its path.

13 Claims, 11 Drawing Figures

DITCHER HEAD ASSEMBLY FOR CLEANING DITCHES

BACKGROUND OF THE INVENTION

The present invention relates to a method of cleaning roadside ditches wherein a ditcher head assembly is employed on a forward moving tractor. The rotary ditcher head assembly is moved along a ditch by means of a multiplicity of cutter blades which extend in a forward direction of movement of the tractor and ditcher head assembly. Under certain conditions paddles may be used in place of blades. Each blade is capable of cutting discrete segments of earth and debris in a ditch as a result of the rotary movement of a cutter blade through the ditch.

The tractor with this ditcher head assembly has hydraulic power takeoff and a reservoir. The ditcher assembly is articulated so that it extends out a number of feet adjacent the berm of a highway and may be extended down into a ditch for cleaning of earth and debris.

The ditcher head assembly is mounted on a support stand on the tractor and has a vertical beam with a pair of articulated outrigger members hydraulically connected to the support stand.

A number of ditcher heads are known in the prior art, such as the Ditch Master, a trademark of The Ditch Master Corporation of Spokane, Wash., and the Speicher-DMT rotary side ditcher of Celina, Ohio.

The following U.S. patents are also known and are of interest to this invention:

U.S. Pat. No. 3,087,296, Cowles,
U.S. Pat. No. 4,206,580, Truax et al.
U.S. Pat. No. 3,949,539, Cartner
U.S. Pat. No. 4,048,789, Cartner
U.S. Pat. No. 2,997,835, Stewart
U.S. Pat. No. 3,308,611, Barber
U.S. Pat. No. 2,588,004, Holmes
U.S. Pat. No. 3,045,413, Sheffer
U.S. Pat. No. 1,911,516, Landing
U.S. Pat. No. 2,791,081, Allen
U.S. Pat. No. 2,832,183, Pittman
U.S. Pat. No. 2,457,693, Leicy The invention herein differs from the known prior art in that the unit assembly moves in a forward direction to cut discrete new segments with each rotation of the ditcher head and cutter blades to loosen the earth so that it may be propelled laterally of the ditch. Other features include a break-away, and the entire ditcher head assembly moves laterally through a 45° angle to the rear of the tractor as it moves in the event an obstruction is met.

The prior art, on the other hand, employs rigid arms for lifting up and down by means of a cable. Further there is no articulation in the arms of such tractor/-ditcher heads.

The unit of this invention is articulated so that it is possible for both the hydraulic cylinders to control the position of the ditcher head, making it possible for the ditcher head to be moved any number of feet away from the tractor and to reach any depth of a ditch. In other words, the ditcher flares out as it comes up against an embankment or a bridge and follows the natural flow of water in a ditch. If there are temporary rises along the berm of a highway, the outrigger members are elevated to avoid the obstruction.

DESCRIPTION OF THE PREFERRED EMBODIMENT

A description of the preferred emodiments of the invention will now be made with reference to the accompanying drawings in which.

Figure 1:
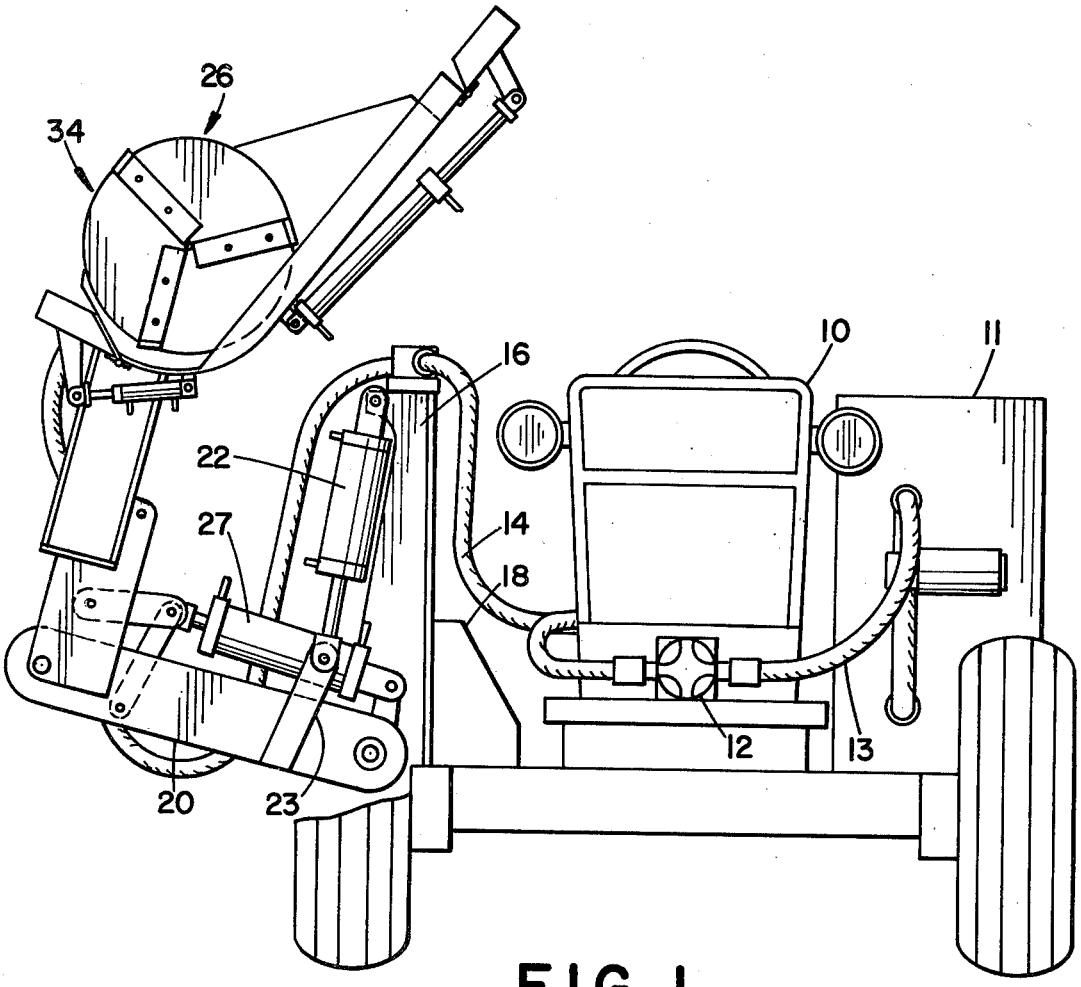
FIG. 1 is a front view of the ditcher head assembly mounted on a tractor and shown in travel position.

The ditcher head assembly as mounted on a tractor is generally shown at 10 in FIG. 1. It has a large capacity hydraulic reservoir as shown at 11. Hydraulic power which operates the ditcher head assembly is shown at 12, while connecting hoses therefor are shown at 13 and 14. FIG. 1 is actually the travel position for the ditcher head, but the components are best illustrated in connection with FIG. 3.

Figure 2:
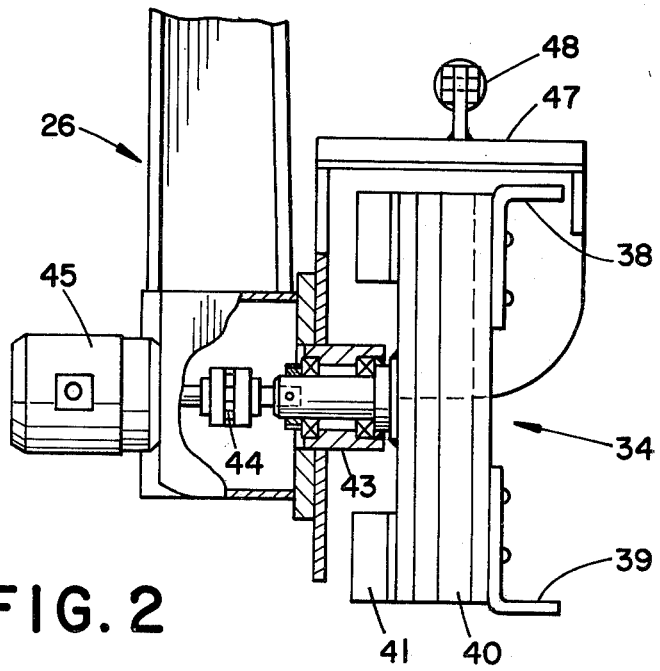
FIG. 2 is a view of the ditcher head partially cutaway to show the cutter blades.
Figure 3:
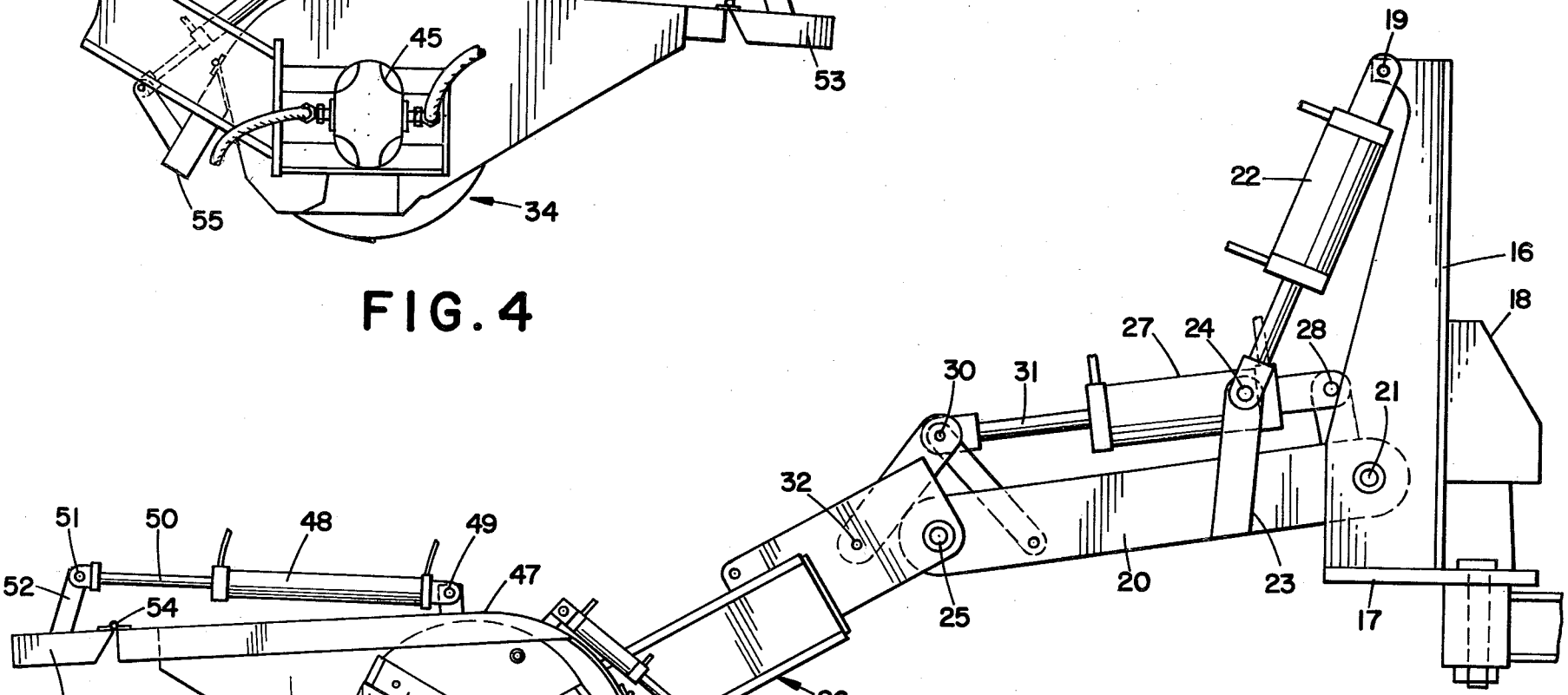
FIG. 3 is a front view of a ditcher head assembly in extended position over the berm of a highway.
Figure 4:
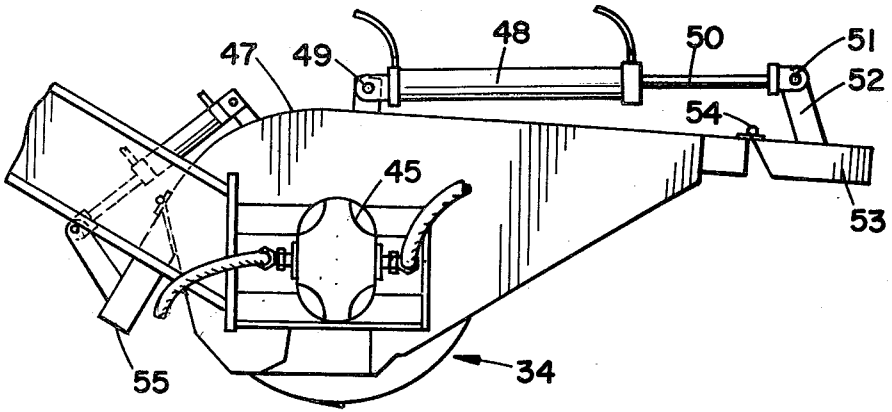
FIG. 4 is a rear view of the ditcher head motor and ditcher flaps and actuating means.

FIG. 2 is a partial cut-away portion of the ditcher head and showns the hydraulic motor, coupling and supports for the ditcher head and the cutting blades. FIG. 3 shows the entire ditcher head assembly and consists of a support stand 16 with its base portion 17. The support structure is generally indicated at 18, and the top pivot point is shown at 19. A first outrigger member 20 is pivotally connected to the sides and the support stand at 21, and a first hydraulc cylinder 22 is connected to stand 23 and attached to the outrigger member 20 at pivot point 24. The opposite end of the outrigger is pivoted as at 25 to the ditcher head assembly generally indicated at 26.

A second hydraulic cylinder is pivotally connected to an extension as shown at 28 and attached to outrigger member 20. There is a second pivotal extension 30 and piston rod 31 linked to the ditcher head assembly at 32. Cylinder 27 when hydraulically actuated pivots the ditcher head and lifts it with respect to the outrigger.

The ditcher head assembly 26 includes the ditcher head at 34 with a series of cutter blades shown thereon at 35, 36, and 37 and angled slightly outwardly. Vertical members 38 and 39 extend forward as shown in FIG. 2, but a third member is not visible in this view.

The ditcher head is mounted on the ditcher head assembly by means of support members 40, and there are clean-out paddles on the rear side thereof, two of which are illustrated at 41 and 42 and are mounted by means of rigid bearing supports 43 and a break-away coupling 44 driven by hydraulic motor 45.

Housing 47 extends around the ditcher head to protect against flying debris, and a pair of hydraulic cylinders, one of which is shown at 48, are mounted onto housing 47 at pivot 49. A piston rod extends out as at 50 to pivot point 51 and an arm extension 52 is connected to flap 53. Actuation of the cylinder causes it to move the piston rod and pivot point to rotate flap 53 by means of hinge 54, enabling debris from the ditcher head to be dropped adjacent thereto. A similar flap is shown generally at 55. Flaps may be located on either side of the ditcher head assembly.

It is clear, then, that there are three blades which extend in a forward direction at 90° angle. They are sharpened for use on either side so as to cut into the soil and loosen it as it passes through the earth. The knives rotate at 500-700 rpm and cut segments of 1, 2, or 3 inches deep upon each cut. The earth is then projected outwardly against the flaps, if one is down, or moves to either side of the highway depending upon the direction of hydraulic motor rotation. The earth loosens by cutting action and since there is sufficient friction as it moves against the fact of the ditcher head, it is projected forcefully to one side of the highway.

The flaps (or deflectors) help lay the debris and earth down close to the ditch to prevent its being thrown all over the highway or the area adjacent the roadway. Others may then take the earth and debris moved along the highway by use of graders or front-end loaders which pick up the extra earth. Cutting blades are required to be spaced at intervals because here is an abrasive action of the soil and sand in the ditch.

Figure 5:
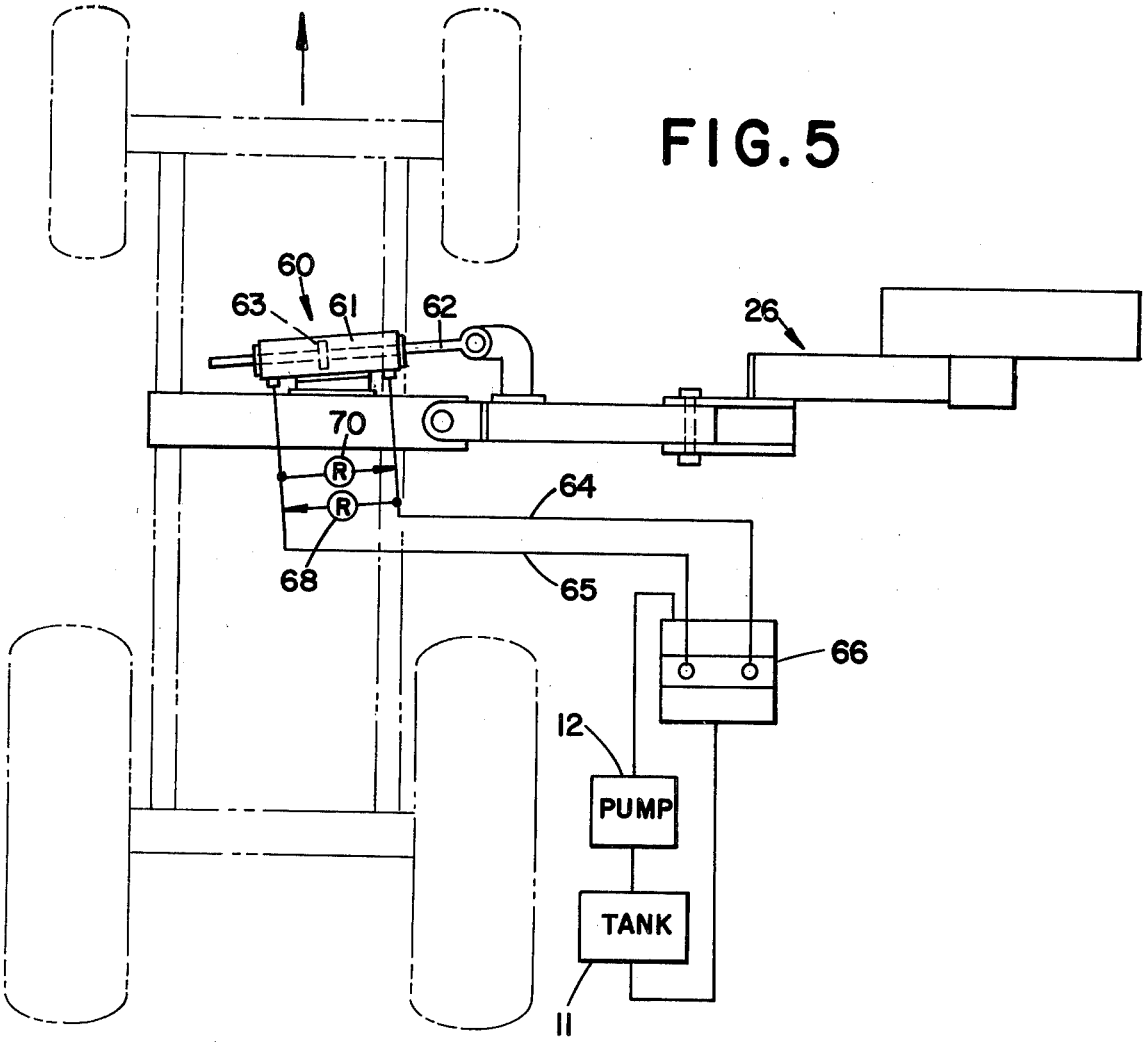
FIG. 5 is a schematic view of a break-away system for use in conjunction with the arm structures of FIGS. 1, 10, and 11.

FIG. 5 illustrates the hydraulic circuit for the swing ram and hydraulic break-away cylinder 60. The circuit includes hydraulic pump 12 driven by the power takeoff of the tractor. The cylinder 60 has a cylinder housing 61 which receives a continuous through rod 62 on which a piston 63 is mounted. The through rod and the cylinder are connected with the boom and the tractor, respectively. Cylinder 60 receives pressure fluid from either of lines 64 or 65 under the control of a conventional, manually controlled valve 66 which has a center position in which the flow of fluid in both of lines 64 and 65 is blocked, thereby locking the swing ram 60 in any desired position. Commonly, the ram 60 is so locked with the ditches assembly 26 transverse to the tractor in the position illustrated. When the cutter blade strikes a stationary object so as to be forced rearwardly, the ram piston is forced to the right. The fluid pressure will increase in the front or right side of the ram cylinder until the pressure differential across a relief valve 68 is sufficient for the fluid to flow therethrough to the rear or left side of the ram cylinder. Analogously, a force exerted on the cutter blade in an opposite direction increases fluid pressure in the rear or left side of the ram cylinder until fluid flows through a second relief valve 70 to the lower pressure front or right side of the ram cylinder. A similar sequence of flow occurs if an object is encountered when the manually controlled valve 66 is positioned to pressurize either line 64 or line 65 to swing the ditcher head assembly 26.

Figure 6:
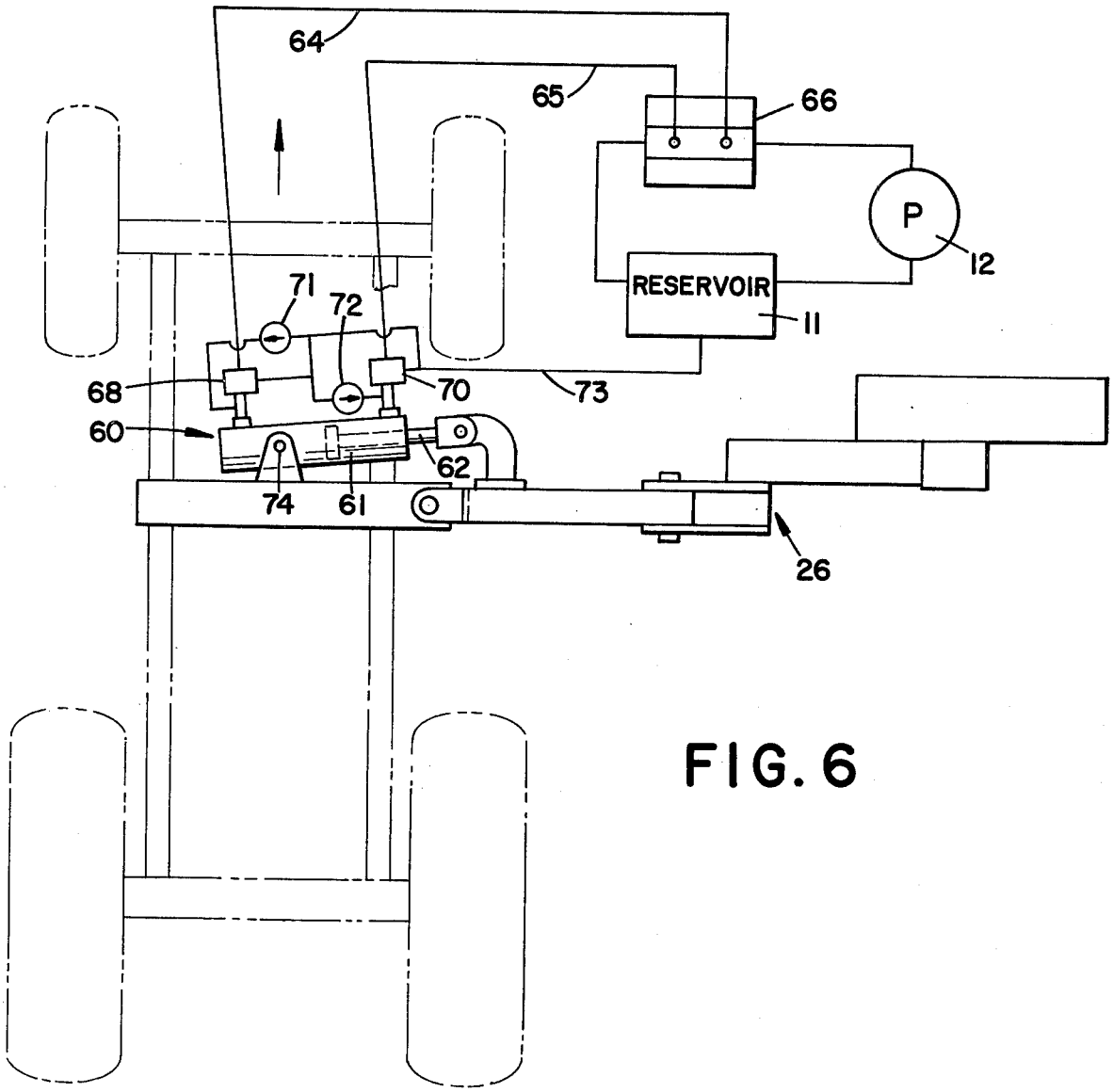
FIG. 6 is a schematic view of an alternate breakaway system.

FIG. 6 illustrates an alternate hydraulic break-away circuit in which relief valves 68 and 70 are located in lines 64 and 65, respectively from the manual control valve 66. In response to a large rearward force on the ditcher head assembly 26, relief valve 70 releases the increased pressure in the front side of ram cylinder 60 through a check valve 71 to the rear side. Analogously, in response to a large forward force on the ditcher head assembly 26, relief valve 68 releases the increased fluid pressure in the rear side of the ram cylinder through a check valve 72 to the front side. A fluid reservoir line 73 provides a return path to the reservoir for excess fluid from the increased pressure side of the cylinder or a fluid supply path from the reservoir to the decreased pressure side of the cylinder, as may be required. The cylinder housing 61 is pivotally connected to the tractor at 74.

Figure 7:
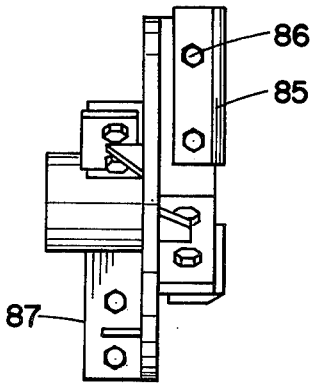
FIG. 7 is a side view of a modified ditcher head with paddle blades.
Figure 8:
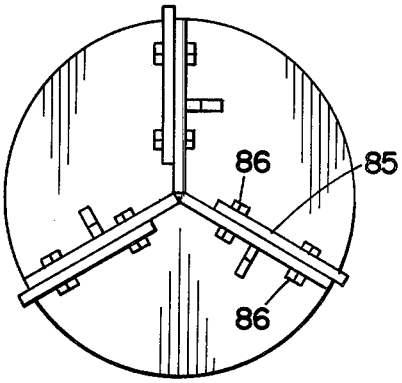
FIG. 8 is a rear view of FIG. 7 showing the clean-out paddles.

FIG. 7 illustrates a side view of a modified cutter blades which might be described at a paddle. It works on a brute force concept, tearing a segment of soil from the earth on the presentation of each new blade. A blade or paddle 85 is fastened with bolts 86. The paddles on the rear side operate as clean-cut paddles 87. FIG. 8 shows the front view of the ditcher head. Similar hydraulic overload protection is provided for vertical movement of the ditcher head assembly.

Figure 9:
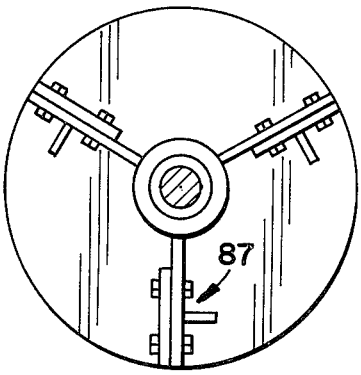
FIG. 9 is a front view of the modified ditcher head of FIG. 7.

The method of this invention, then, consists of rotating a ditcher head assembly, i.e. about 24–45 percent of the diameter of the ditcher head, in a ditch adjacent to the berm of a highway at enough speed to allow each of the cutter blades or paddles to cut discrete segments of earth and then project that earth to one side of the highway, either onto the berm or away from the highway itself. The cutter blade includes a knife which projects outwardly and has a component sharpened on both sides thereof so that it cuts the earth. A hydraulic motor drives the cutter blade in either direction, and the blade moves at 500–700 rpm to cut a new segment of earth and debris, which is the projected to one side as the tractor moves in a forward direction at 1–5 mph. Paddles in FIGS. 7–9 work in a different manner but accomplish the same result.

Figure 10:
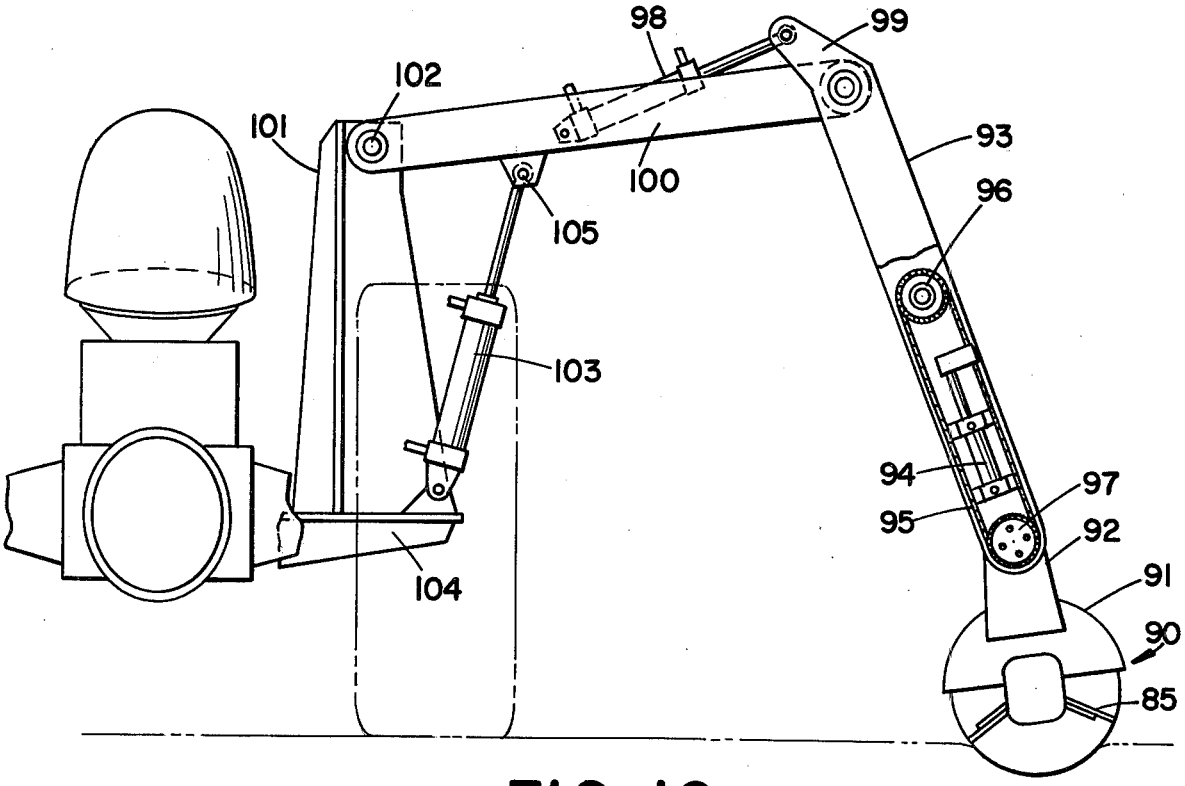
FIG. 10 is a view of an alternate version of a ditcher head showing an articulated boom.
Figure 11:
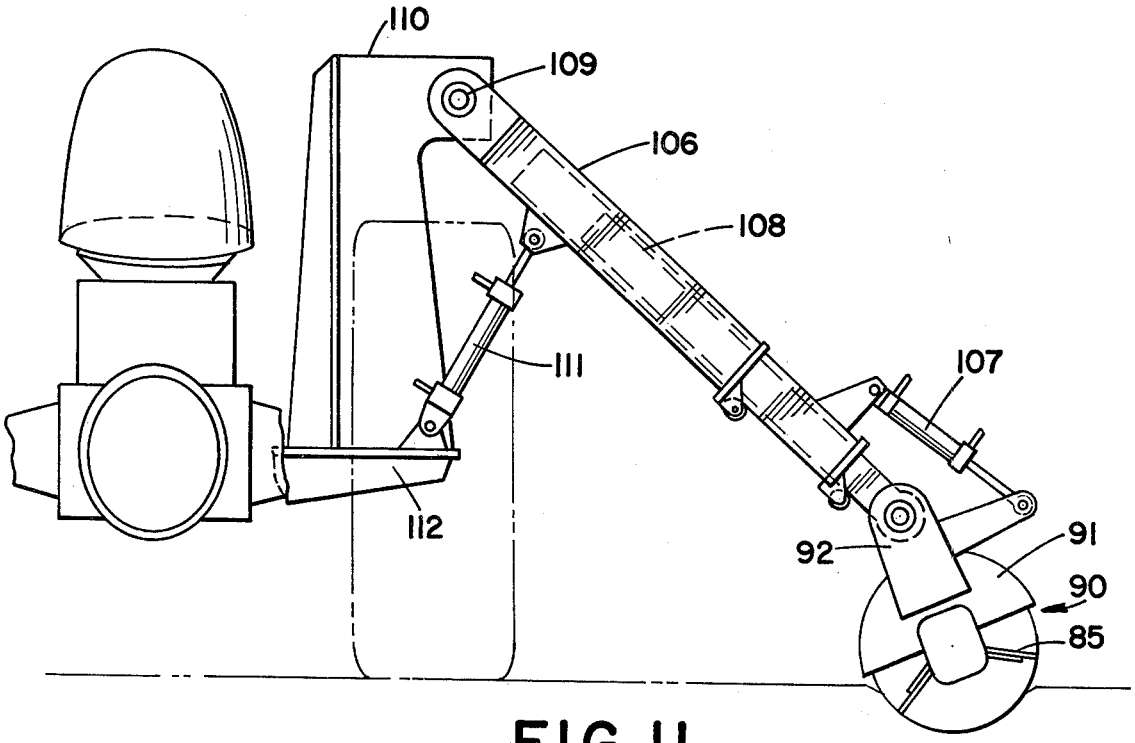
FIG. 11 is a further alternate version of a ditcher head boom arm assembly.

The ditcher head of this invention may be on an extended boom as shown in FIG. 11, or it may be on an articulated boom as shown in FIG. 10.

A ditcher head 90 has a housing 91 and blades 85. Support for the ditcher head is from housing arm 92 which is pivoted to boom 93 and positioned by means of hydraulic cylinder 94, which moves chain 95 around two sprockets 96 and 97. Boom 93 is positioned through cylinder 98 and moving arm 99.

Boom 93 is mounted at the end of boom 100, which is pivoted to support stand 101 at 102 and supported by cylinder 103 from base 104 intermediate boom 100 at 105. Movement of the ditcher head is controlled and positioned by the boom and controls above identified.

FIG. 11 illustrates an extended boom ditcher head assembly. Ditcher head 90 has a housing 91 and blades 85, which are supported from housing arm 92 and pivoted from boom 106 by means of cylinder 107. The boom is telescopically extendable, as shown at 108. Boom 106 is pivoted at 109 to stand 110 and held in position through cylinder 111 which is connected to base 112 and boom 106. The operation of the ditcher head in this view is substantially the same, however.

The tractor has a large hydraulic reservoir on one side of the tractor and a vertical hydraulic stand which mounts an outrigger and is articulated and comprises a first outrigger member and the ditcher head assembly member, all of which are articulated and power actuated with respect to one another. The outrigger thus may be lifted up and the ditcher head assembly may be rotated with respect to the outrigger. The ditcher head passes outwardly, from 8–15 feet off the highway or 2–5 feet down below the tractor level. Hydraulic controls are used to control movement of the ditcher head and the assembly utilizes one or two flaps that extend to either side of the rotary ditcher head to drop soil as it is projected outwardy from the head.

The boom of U.S. Pat. No. 3,949,539 may be used to attach the ditcher head and to carry the head over the berm or guardrails.

This invention has been described in detail sufficient to enable one of ordinary skill in the art to make and use the same. Obviously, modifications and alterations of the preferred embodiment will occur to others upon a reading and understanding of the specification, and it is the intention to includes all such modifications and alterations as part of the invention insofar as they come within the scope of the appended claims or the equivalents thereof.

What is claimed:

1. A ditcher combination comprising a tractor and ditcher assembly adapted to clean earth and debris from a ditch along the berm of a highway, comprising:

A. a tractor having a hydraulically powered take-off and a reservoir therefor;

B. a support stand pivotally connected to said tractor for rotation about a vertical axis;

C. a first outrigger member pivotally connected to the support stand and extending outwardly therefrom;

D. a first elevating hydraulic cylinder pivotally connected between the support stand and said first outrigger member;

E. a second outrigger arm pivotally connected to the first outrigger member and supporting a ditcher assembly;

F. a second hydraulic cylinder extending generally parallel to said first outrigger member and attached thereto and being operatively connected with the second outrigger arm;

G. a third hydraulic cylinder operatively connected between the tractor and at least one of the support stand and the first outrigger member, the third hydraulic cylinder having overload protection such that the entire support stand, first outrigger member, second outrigger arm, and the ditcher assembly will pivot horizontally about said vertical axis in the event the ditcher assembly meets an obstruction to avoid damaging the ditcher assembly;

H. the ditcher assembly having a ditcher head, a ditcher housing at least partially surrounding said head, and a ditcher arm operatively connecting the ditcher head with the second outrigger arm;

I. a ditcher plate at least partially in said ditcher housing secured to a shaft and driven by a hydraulic motor; and J. paddle supports being attached to said ditcher plate.

2. The tractor and ditcher assembly of claim 1 having a coordinated hydraulic control of said first and second hydraulic cylinders to raise and lower the ditcher head in an articulatd manner as well as to move said ditcher horizontally to provide for coordinated control of the ditcher head over the berm of a highway.

3. The tractor and ditcher assembly of claim 1 wherein each of the first and second hydraulic cylinders have overload protection so that the ditcher head will elevate in the event that the cutter blade and supports meet a sever resistance in order to protect the ditcher head from damage.

4. The tractor and ditcher assembly of claim 1 wherein the third, overload protected hydraulic cylinder includes a cylinder housing and a through rod, one of which is operatively connected with the tractor and the other of which is operatively connected with the support stand.

5. The tractor and ditcher assembly of claim 1, wherein there are two flaps on the ditcher housing, each of which is hydraulically controlled, one outwardly of the housing and the other inwardly of the housing, and wherein the hydraulic motor revolves in either direction so that earth and debris may be moved from the ditch and dropped to either side thereof.

6. The tractor and ditcher assembly of claim 1, wherein the outrigger and ditcher arm assembly are controlled by the first elevating hydraulic and the second hydraulic cylinder so that the ditcher head may be closely controlled and moved into the ditch by a controlled amount simultaneously with being carried over the berm of the highway in articulate manner so that close control of the ditch depth is provided for as well as lateral variations in the ditch relative to the road.

7. The tractor and ditcher assembly of claim 1 wherein the cutter blades are substantially tangential to the plate and project forwardly.

8. The tractor and ditcher assembly of claim 1 wherein the paddle supports have cutter blades.

9. A ditcher head and arm assembly which is adapted to be selectively mounted on a prime mover to clear a ditch adjacent a berm of a highway, the ditcher head and arm assembly comprising:

a. a support stand including a vertical pivot means for enabling the support stand to rotate horizontally about the vertical axis, the support stand pivot means being adapted for interconnection with the prime mover;

b. a first outrigger member pivotally connected with the support stand by a first pivot means such that the first outrigger member pivots about a first horizontal axis relative to the support stand;

c. a second outrigger member pivotally connected to the first outrigger member for pivotal movement about a second horizontal axis, the second outrigger member supporting the ditcher head;

d. a first hydraulic cylinder operatively connected between the support stand and the first outrigger member for selectively rotating the first outrigger member about the first horizontal axis relative to the support stand;

e. a second hydraulic cylinder operatively connected between the first outrigger member and the second outrigger member for selectively rotating the second outrigger member relative to the first outrigger member about the second horizontal axis such that the first and second hydraulic cylinders operating together control the vertical position of the ditcher head relative to the support stand and control the relative distance horizontally between the support stand and the ditcher head, whereby the first and second hydraulic cylinders cooperatively interact to position the ditcher head selectively within a first vertical plane;

f. a third hydraulic cylinder for rotating the support stand, the first and second outrigger members together about said vertical axis, whereby the third hydraulic cylinder rotates the vertical plane about the vertical axis; and, g. the ditcher head including a ditcher housing which is operatively connected to the second outrigger member, a ditcher motor mounted on the ditcher housing for rotating a ditcher plate in a substantially vertical plane, and a plurality of ditcher paddles mounted generally radially on the ditcher plate for throwing dirt and debris from the ditch as the ditcher plate is rotated and advances.

10. The ditcher head and arm assembly as set forth in claim 9 wherein at least one of the first, second, and third hydraulic cylinders includes overload protection such that the ditcher head is pivoted about at least one of the vertical axis and the first and second horizontal axes when the ditcher head meets and obstruction to avoid damaging the ditcher head.

11. The ditcher had and arm assembly as set forth in claim 9 wherein at least one of the first and second hydraulic cylinders includes overload protection such that the ditcher head moves upward in the event the ditcher assembly meets an obstruction to avoid damaging the ditcher assembly.

12. The ditcher had and arm assembly as set forth in claim 9 wherein the third hydraulic cylinder includes overload protection such that the support stand, the first outrigger member, the second outrigger member, and the ditcher pivot about the horizontal axis in the event the ditcher assembly meets an obstruction to avoid damaging the ditcher assembly.

13. The ditcher head and arm assembly as set forth in claim 9 wherein the ditcher head further includes a first flap pivotally connected to the ditcher head housing and controlled by a first ditcher head hydraulic cylinder for directing the discharge of dirt and debris and a second flap pivotally connected to an opposite side of the ditcher housing and controlled by a second ditcher head hydraulic cylinder for directing the discharge of earth and debris to the other side of the ditcher head, and wherein the ditcher motor is reversible such that dirt and debris can be discharged and directed toward either side of the ditcher head.

* * * * *